US008939221B2

(12) United States Patent
Murray

(10) Patent No.: US 8,939,221 B2
(45) Date of Patent: Jan. 27, 2015

(54) HIGH PRESSURE LOCK ASSEMBLY

(75) Inventor: Douglas J. Murray, Christiansburg, VA (US)

(73) Assignee: Baker Hughes Incorporated, Houston, TX (US)

( * ) Notice: Subject to any disclaimer, the term of this patent is extended or adjusted under 35 U.S.C. 154(b) by 304 days.

(21) Appl. No.: 13/343,886

(22) Filed: Jan. 5, 2012

(65) Prior Publication Data

US 2013/0175027 A1 Jul. 11, 2013

(51) Int. Cl.
*E21B 23/02* (2006.01)

(52) U.S. Cl.
USPC ..... 166/382; 166/139; 166/217

(58) Field of Classification Search
CPC .. E21B 23/02; E21B 33/1291; E21B 33/1293
USPC ..... 166/382, 237, 216, 217, 138, 139
See application file for complete search history.

(56) References Cited

U.S. PATENT DOCUMENTS

| | | | | | |
|---|---|---|---|---|---|
| 4,051,897 | A | | 10/1977 | Kingelin | |
| 4,069,865 | A | | 1/1978 | Gazda et al. | |
| 4,254,829 | A | | 3/1981 | Watkins | |
| 4,510,995 | A | | 4/1985 | Krause, Jr. et al. | |
| 4,545,434 | A | * | 10/1985 | Higgins | 166/217 |
| 4,583,591 | A | | 4/1986 | Krause, Jr. et al. | |
| 4,745,974 | A | * | 5/1988 | Higgins | 166/217 |
| 4,944,345 | A | * | 7/1990 | Mashaw, Jr. | 166/206 |
| 4,962,813 | A | * | 10/1990 | Welch | 166/217 |
| 4,986,362 | A | * | 1/1991 | Pleasants | 166/382 |
| 4,997,038 | A | * | 3/1991 | Welch | 166/214 |
| 5,348,087 | A | * | 9/1994 | Williamson, Jr. | 166/115 |
| 5,398,764 | A | * | 3/1995 | Collins | 166/382 |
| 7,360,594 | B2 | * | 4/2008 | Giroux et al. | 166/242.6 |
| 8,490,691 | B2 | * | 7/2013 | Purkis | 166/237 |
| 8,596,350 | B2 | * | 12/2013 | Fay et al. | 166/217 |
| 8,607,860 | B2 | * | 12/2013 | Avant et al. | 166/208 |
| 2009/0114401 | A1 | * | 5/2009 | Purkis | 166/382 |
| 2012/0186804 | A1 | * | 7/2012 | Fay et al. | 166/216 |
| 2012/0186805 | A1 | * | 7/2012 | Fay et al. | 166/240 |
| 2012/0186806 | A1 | * | 7/2012 | Fay et al. | 166/240 |

FOREIGN PATENT DOCUMENTS

| | | | |
|---|---|---|---|
| GB | 2366310 | A | 3/2002 |
| WO | 2011028573 | A2 | 3/2011 |
| WO | 2012103136 | A2 | 8/2012 |

OTHER PUBLICATIONS

Wireline Solutions Downhole Completion Tools, [online]; [retrieved on Feb. 14, 2012]; retrieved from the Internet www.wirelinesolutions.net/uploads/Blanking_Plugs.pdf, "Blanking Plugs," 21p.
GB Search Report for Application No. GB1221256.9 Mailed on Feb. 26, 2013, 5 pages.
GB Search Report for Application No. GB1221258.5 Mailed on Feb. 19, 2013, 5 pages.

* cited by examiner

*Primary Examiner* — Jennifer H Gay
(74) *Attorney, Agent, or Firm* — Cantor Colburn LLP

(57) ABSTRACT

A lock assembly including a mandrel having one or more windows arranged alternatingly with one or more struts. One or more dogs are included corresponding to the one or more windows and are radially extendable therethrough. A member is operatively arranged for radially extending each of the one or more dogs. Each of the one or more dogs is operatively coupled between the member and the mandrel when fully radially extended by the member for bypassing loading in the one or more struts during loading of the assembly.

11 Claims, 2 Drawing Sheets

HIGH PRESSURE LOCK ASSEMBLY

BACKGROUND

Lock assemblies are ubiquitous in the downhole drilling and completions industry. One common type of lock assembly involves locking a plug, choke, pressure holding device, tool, etc., in place by radially extending a plurality of dogs into engagement with corresponding features of a radially disposed tubular. In order to accommodate the dogs, windows must be formed in a mandrel or other component of the tubular string, with relatively narrow struts located between each window presenting likely failure points when the string experiences high pressure situations. This results in the need to balance the width of the dogs and the width of the struts, as making either too small can result in failure of the system (e.g., inability of the dogs to lock the string in place and/or fracture of the struts due to heavy loading). In view of these issues and the prevalence of dog type locking systems in the industry, advances and alternatives in the field of lock assemblies are always well received.

BRIEF DESCRIPTION

A lock assembly including a mandrel having one or more windows arranged alternatingly with one or more struts, one or more dogs corresponding to the one or more windows and radially extendable therethrough, and a member operatively arranged for radially extending each of the one or more dogs, each of the one or more dogs operatively coupled between the member and the mandrel when fully radially extended by the member for bypassing loading in the one or more struts during loading of the assembly.

A method of locking an assembly including causing relative movement between an extender member and a mandrel, the mandrel including one or more windows arranged alternatingly with one or more struts, extending one or more dogs with the extender member through the one or more windows due to the relative movement, landing the one or more dogs at a landing feature, and bypassing loading the in the one or more struts during loading of the assembly due to the one or more dogs being operatively coupled between the mandrel and the member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
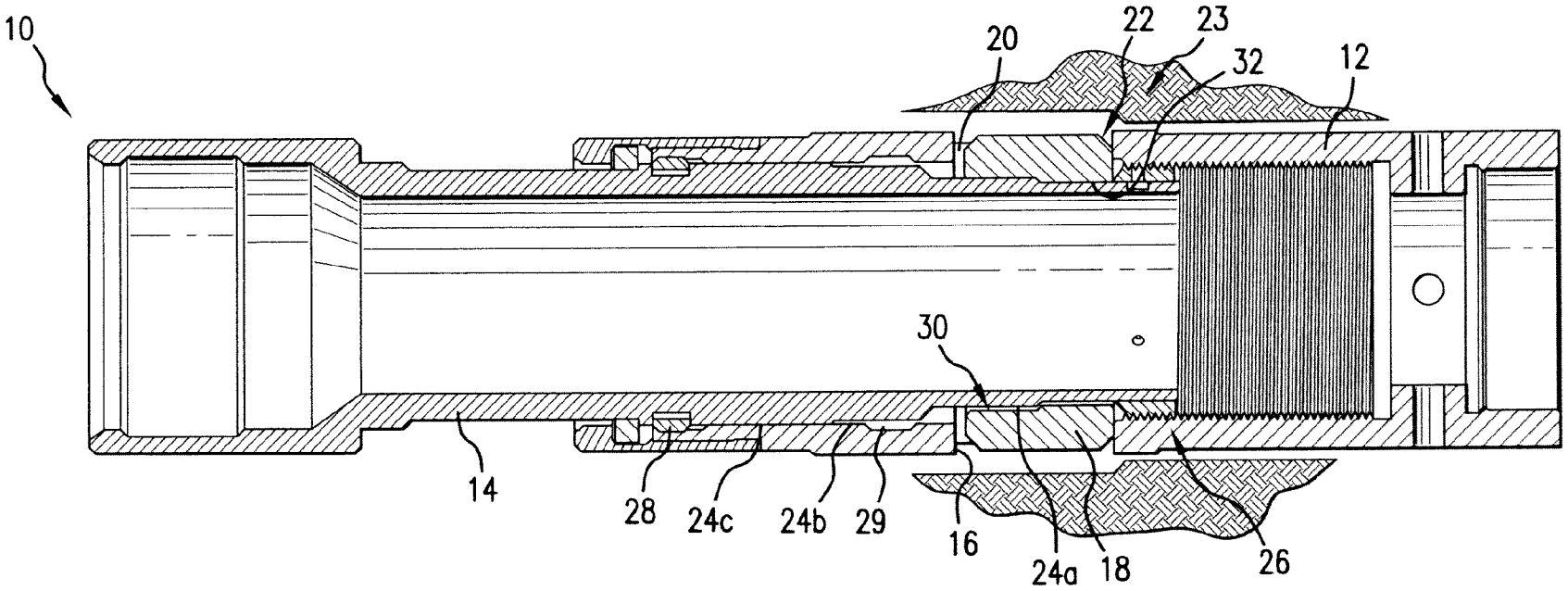
FIG. 1 is a cross-sectional view of a lock assembly having dogs in a retracted state.

Referring now to FIG. 1, a locking assembly 10 is shown having a mandrel 12 and an extender 14. The mandrel 12 includes plurality of windows 16 for accommodating a plurality of locking dogs 18 therein, with one dog 18 in each window 16. The mandrel 12 further includes struts 20, with one strut 20 located adjacently between each pair of the windows 16. The mandrel 12 and the extender 14 are, for example, part of a tubular string runnable downhole in a borehole.

The extender 14 is arranged to radially extend dogs 18, either radially inwardly or outwardly, through respective ones of the windows 16. For example, the dogs 18 include a surface 22 that is arranged to correspondingly engage with another surface, e.g., a landing nipple, recess, radial restriction or other engagement surface in a tubular radially disposed with the assembly 10. For example, the assembly 10 could be run inside of a production tubing string, with the production tubing string including recesses or a landing nipple for receiving the surface 22 of the dogs 18. For the sake of discussion, a landing nipple 23 of a radially disposed tubular is shown in FIG. 1 (the rest of the tubular including the landing nipple 23 being truncated for clarity of the assembly 10). Of course, this is just one example and other arrangements are possible and will be recognized by one of ordinary skill in the art in view of the description of the embodiments herein.

Figure 2:
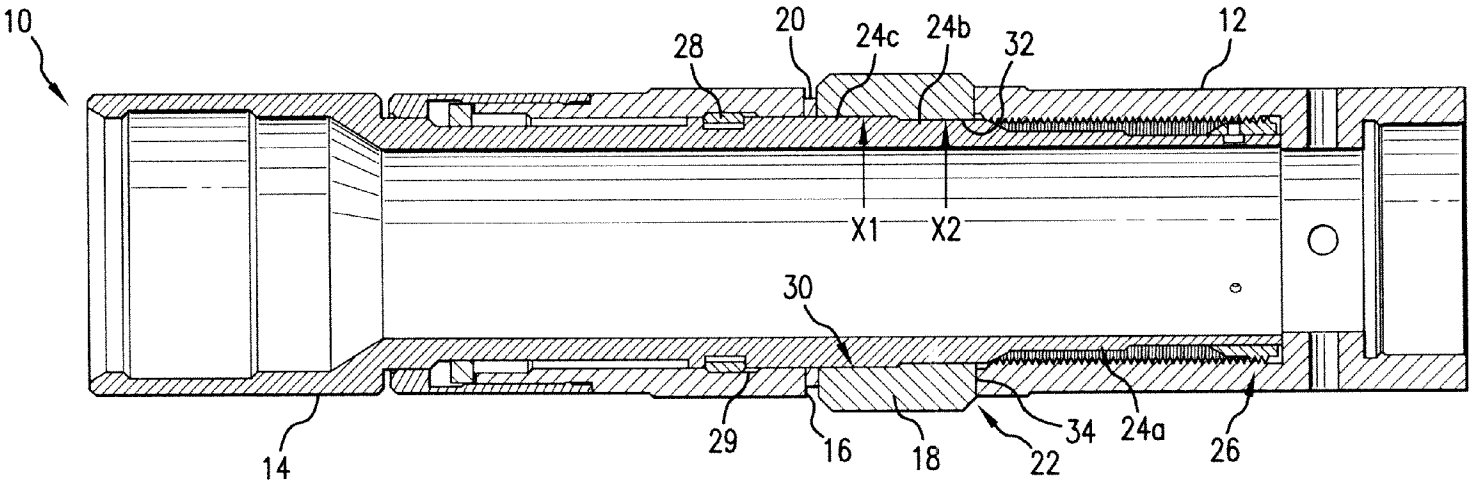
FIG. 2 is a cross-sectional view of the lock assembly of FIG. 1 with the dogs in an extended state.

In the illustrated embodiment, the extender 14 includes a plurality of steps (or tiers, ramps, etc.) 24*a*-24*c*. Each step 24*a*-24*c* is formed as a portion of the extender 14 having a different radial dimension than the other steps for enabling the dogs 18 to progressively extend from the mandrel 12 as the dogs 18 are successively engaged with each step 24*a*-24*c*. Any suitable number of steps, ramps or tiers, including just one, could be utilized in other embodiments for extending the dogs 18 to any desired degree. Thus, in the illustrated embodiment, by axially moving the extender 14 with respect to the dogs 18, the dogs 18 engage successively with each of the ramps 24*a*-24*c*, resulting in the dogs 18 extending incrementally further through the windows 16 of the mandrel 12. The dogs 18 are shown fully retracted in FIG. 1 and fully deployed in FIG. 2.

In the illustrated embodiment, a threaded connection 26 enables axial movement of the extender 14 with respect to the mandrel 12, and therefore the dogs 18, which are held in the windows 16. Once fully threadingly engaged, a lock mechanism 28, e.g., a radially compressed ring or c-ring, is arranged to spring outwardly into a corresponding recess 29 for preventing any further relative movement between the extender 14 and the mandrel 12. Other devices for enabling, and then restricting, relative movement between the mandrel 12 and extender 14 could be used, e.g., a ratcheting device or body lock ring between the mandrel 12 and the extender 14, etc. It is also to be recognized that non-axial movement of the extender 14 could cause extension of the dogs 18, e.g., the extender 14 could be a cam (e.g., with ramps of different dimensions arranged circumferentially as opposed to longitudinally) for enabling rotation of the extender 14 to selectively deploy the dogs 18.

Since the struts 20 are of a narrowed circumferential width (in order to form the windows 16), the struts 20 present relatively weak sections of the mandrel 12 that are more likely to fail if the mandrel 12 is subjected to high forces. That is, as the assembly 10 is a locking assembly, it will inevitably be loaded in one or both directions, e.g., by weight of the string with which the assembly 10 is run, pressuring up chambers on either axial side of the assembly, etc.

Accordingly, it is one purpose of the current invention as described herein to avoid loading of, or stress in, the struts 20 during loading of the assembly 10 in or from either axial direction. As discussed above, the extender 14 includes a plurality of ramps 24*a*-24*c*. In the illustrated embodiment, the ramps 24*b* and 24*c* define a set of radial dimensions x1 and x2. The dogs 18 include a surface 30 having a projection 32 therefrom, which respectively share the dimensions x1 and x2 when the dogs 18 are engaged with the ramps 24*b* and 24*c*, and are therefore fully extended by the extender 14. The radial difference between the two dimensions x1 and x2 creates a radial overlap x3 between the projection 32 of the dogs 18 and the step 24*c* of the extender 14. It is noted that a similar overlap is formed by the step 24*a* in order to stabilize the dogs 18 in their run-in positions shown in FIG. 1.

Figure 3:
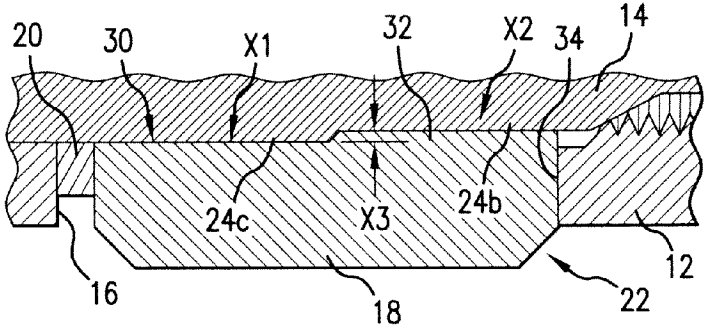
FIG. 3 is an enlarged view of one of the dogs of FIG. 2 showing a radial overlap between the dog and an extender for the dog.

The overlap x3 is shown most clearly in FIG. 3. When the extender 14 becomes fully actuated, e.g., by fully threading the connection 26 between the extender 14 and the mandrel 12, the step 24*c* of the extender 14 will bottom out on the projections 32 of the dogs 18. In turn, the dogs 18 will bottom out on an edge 34 of the windows 16 of the mandrel 12. Since movement of the extender 14 is prevented by the lock device 28, each of the dogs 18 becomes axially locked between the step 24*c* of the extender 14 and the edge 34 of each of the windows 16. Effectively, this makes the dogs 18 a fixed part of the mandrel 12. In this way, any pressure on the mandrel 12 (e.g., due to a pressure event downhole of the mandrel 12) will transfer through the threaded connection 26 to the extender 14, where it will transfer from the step 24*c* of the extender 14 to the projection 32 of the dogs 18 (due to the radial overlap x3), and from the dogs 18 to the landing nipple 23. In the opposite direction, weight down on the extender 14 will transfer directly through the step 24*c* to the dogs 18 to the landing nipple 23. Advantageously, the radial overlap x3 enables a bypass of the struts 20 so that they are not stressed during loading (e.g., without the overlap x3, the dogs 18 would shift to the edges of the windows 16 opposite from the edges 34, thereby putting the struts 20 into tension).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A lock assembly comprising:

a mandrel having one or more windows arranged alternatingly with one or more struts;

one or more dogs corresponding to the one or more windows and radially extendable therethrough; and a member operatively arranged for radially extending each of the one or more dogs, the member comprising one or more steps arranged to engage a projection on the one or more dogs when fully radially extended, each of the one or more dogs axially locked between the one or more steps and an edge of one of the one or more windows when fully radially extended for bypassing loading in the one or more struts during loading of the assembly, wherein rotational movement of the member with respect to the mandrel radially extends the one or more dogs.

2. The assembly of claim 1, wherein axial movement of the member with respect to the mandrel radially extends the one or more dogs.

3. The assembly of claim 2, wherein the at least one dog climbs the at least one step while being radially extended.

4. The assembly of claim 2, wherein the member is threadingly connected to the mandrel.

5. The assembly of claim 1, wherein the member is threadingly connected to the mandrel.

6. The assembly of claim 1, further comprising a lock mechanism for preventing the one or more dogs from retracting once fully extended.

7. The assembly of claim 6, wherein the lock mechanism prevents relative movement between the mandrel and the member.

8. The assembly of claim 7, wherein the lock mechanism includes a ring engagable in a recess when aligned therewith as a result of relative movement between the mandrel and the member.

9. A method of locking an assembly comprising:

causing relative rotational movement between an extender member and a mandrel, the mandrel including one or more windows arranged alternatingly with one or more struts;

extending one or more dogs with the extender member through the one or more windows due to the relative rotational movement;

landing the one or more dogs at a landing feature, the member comprising one or more steps arranged to engage a projection on the one or more dogs when landed at the landing feature; and bypassing loading the one or more struts during loading of the assembly due to the one or more dogs being axially locked between the one or more steps and an edge of one of the one or more windows.

10. The method of claim 9, wherein the mandrel is coupled to the extender member for enabling downhole force in the mandrel to be pulled through the extender member into the one or more dogs.

11. The method of claim 9, wherein the landing feature is a landing nipple of a downhole tubular string.

* * * * *